United States Patent [19]

Whited

[11] 3,967,892

[45] July 6, 1976

[54] DEVELOPMENT SYSTEM

[75] Inventor: Charles A. Whited, Rochester, N.Y.

[73] Assignee: Xerox Corporation, Stamford, Conn.

[22] Filed: July 26, 1974

[21] Appl. No.: 492,305

[52] U.S. Cl. ..... 355/3 DD; 118/637
[51] Int. Cl.[2] ..... G03G 15/00
[58] Field of Search ..... 355/3; 118/637; 427/21

[56] References Cited

UNITED STATES PATENTS

| | | | |
|---|---|---|---|
| 2,732,775 | 1/1956 | Young et al. | 355/3 DD X |
| 3,572,288 | 3/1971 | Turner | 355/3 DD UX |
| 3,636,924 | 1/1972 | Weiler | 355/3 DD X |
| 3,685,485 | 8/1972 | Kutsuwada et al. | 355/3 DD X |
| 3,754,526 | 8/1973 | Caudill | 118/637 |
| 3,754,531 | 8/1973 | Donalies | 118/637 |
| 3,791,730 | 2/1972 | Sullivan | 355/3 DD |

*Primary Examiner*—John Gonzales
*Attorney, Agent, or Firm*—H. Fleischer; J. J. Ralabate; C. A. Green

[57] ABSTRACT

An apparatus in which an electrostatic latent image is developed with electrostatically charged particles. A brush-like array of charged particles is positioned closely adjacent to the electrostatic latent image. A portion of the charged particles are separated from the brush-like array thereof. The separated charged particles are moved into contact with the latent image to render it visible.

The foregoing abstract is neither intended to define the invention disclosed in the specification, nor is it intended to be limiting as to the scope of the invention in any way.

14 Claims, 5 Drawing Figures

DEVELOPMENT SYSTEM

BACKGROUND OF THE INVENTION

This invention relates generally to electrostatographic printing, and more particularly concerns an apparatus for developing an electrostatic latent image.

The process of electrostatographic printing includes both electrographic printing and electrophotographic printing. Both of these processes are quite similar to one another, i.e., an electrostatic latent image corresponding to the original document is recorded on an image bearing member. Electrophotographic printing is disclosed in U.S. Pat. No. 2,297,691 issued to Carlson in 1942. As described therein, a photoconductive member is charged to a substantially uniform potential. The charged photoconductive member is exposed to a light image of the original document. The light image selectively dissipates the charge in the irradiated areas and creates an electrostatic latent image on the photoconductive member. Electrophotographic printing creates an electrostatic latent image corresponding to the original document to be reproduced without the use of a photoconductive material or a light image.

Whatever method is employed in the formation of an electrostatic latent image, a viewable record thereof is usually produced by depositing toner particles thereon, i.e. the process of development. Development may be achieved by bringing the latent image into contact with the developer mix. Typical developer mixes employed in the art generlly comprise toner particles, such as heat settable colored thermoplastic particles, which electrostatically adhere to coarser carrier granules, such as ferromagnetic granules.

Various types of developing systems are employed in the art and include, amongst others, cascade development, magnetic brush development, powder cloud development, and liquid development. Magnetic brush systems achieve a high degree of uniform deposition and, therefore, are used in numerous electrostatographic printing machines. Various types of hybrid systems are also frequently employed. For example, a combination of cascade and powder cloud development is frequently utilized. One type of hybrid system wherein a cascade and powder cloud development are combined is disclosed in U.S. Pat. No. 3,470,009 issued to Gundlach in 1969. Another type of powder cloud and cascade development system is described in U.S. Pat. No. 3,799,113, issued to Whited in 1974. Both of the foregoing systems describe techniques wherein a developer mix of carrier granules and toner particles cascade in a downwardly direction between an apertured screen and an electrode. Toner particles are separated from the carrier granules and form a cloud thereof adjacent to the electrostatic latent image. Thi s cloud of toner particles thereafter develops the electrostatic latent image.

Multi-color electrostatographic printing involves the utilization of various process components to produce a series of electrostatic latent images corresponding to a particular color in the original document. In such a system, there is a requirement to develop successive partial color images. Each color image is developed with toner particles of a selected color. These powder images are then transferred to a suitable support surface, in registration with one another, to form a reproduction of the colored original document. In most high quality colored electrophotographic printing systems, magnetic brush systems are employed. In magnetic brush systems, development is of the contact type wherein a brush-like array is formed which is in engagement with the electrostatic latent image recorded on the photoconductive surface. It would appear to be highly advantageous to be able to combine a magnetic brush system with powder cloud systems so as to produce a non-contact magnetic brush system having solid area capability.

Accordingly, it is a primary object of the present invention to improve the development apparatus so as to form a non-contact magnetic brush development unit.

SUMMARY OF THE INVENTION

Briefly stated and in accordance with the present invention, there is provided an apparatus for developing an electrostatic latent image with electrostatically charged particles.

In the present invention, this is achieved by means for forming a brush-like array of charged particles closely adjacent to the electrostatic latent image. Means are provided for separating a portion of the charged particles from the brush-like array thereof. Thereafter, moving means advance the separated particles into contact with the latent image. In this manner, charged paticles are deposited on the electrostatic latent image rendering it visible.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents that may be included within the spirit and scope of the invention as defined by the appended claims.

DETAILED DESCRIPTION OF THE INVENTION

Figure 1:
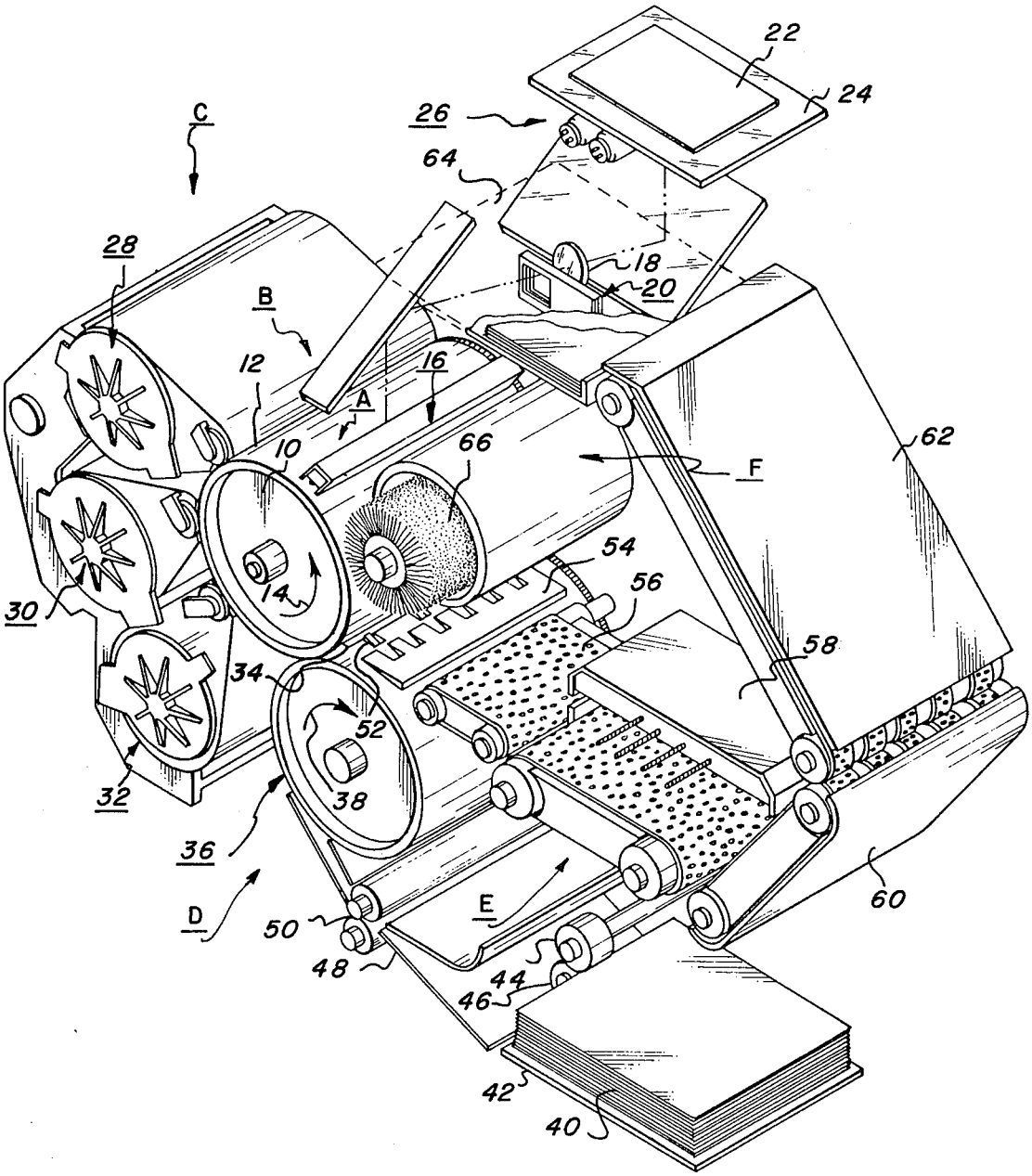
FIG. 1 is a schematic perspective view of a color electrophotographic printing machine incorporating the features of the present invention therein.

For a general understanding of the illustrated electrophotographic printing machine, in which the present invention may be incorporated, reference is had to the drawings wherein like numerals have been used throughout to designate like elements. FIG. 1 schematically illustrates the various components of a printing machine arranged to produce color copies from a colored original document. As in all electrophotographic printing machines of the type depicted, a light image of an original document being reproduced is projected onto a sensitized photoconductive surface recording an electrostatic latent image thereon. This latent image is developed with toner particles forming a powder image thereof. Subsequently, the powder image is transferred to a sheet of support material and affixed substantially permanently thereto so as to produce a copy of the original document.

Turning now to FIG. 1, the printing machine depicted therein utilizes a rotatably mounted drum 10 having a photoconductive surface 12 entrained about and secured to the circumferential surface thereof. Photoconductive surface 12, preferably, is formed from a material having a relatively panchromatic response to light of all colors. A suitable photoconductive material is described in U.S. Pat. No. 3,655,377 issued to Sechak in 1972. Drum 10 is driven at a predetermined speed relative to the other operating mechanisms and rotates in the direction of arrow 14 to move photoconductive surface 12 sequentially through a series of processing stations. A timing disc (not shown) rotates with drum 10 and is adapted to initiate the sequence of events at the various processing stations.

Initially, photoconductive surface 12 passes through charging station A. At charging station A, a corona generating device, indicated generally at 16, extends longitudinally across photoconductive surface 12. Corona generating device 16 is adapted to charge photoconductive surface 12 to a relatively high substantially uniform potential. One type of suitable corona generating device is described in U.S. Pat. No. 2,778,946 issued to Mayo in 1957.

After photoconductive surface 12 is charged to a substantially uniform level, drum 10 rotates to exposure station B. Exposure station B includes a moving lens system, generally designated by the reference numeral 18, and a color filter mechanism, shown generally at 20. An original document 22, such as a sheet of paper, book or the like, is stationarily supported upon transparent platen 24. This enables successive incremental areas of original document 22 to be illuminated by means of a moving lamp assembly 26. Lens system 18 is adapted to focus the light rays reflected from original document 22 forming a light image which is projected onto photoconductive surface 12. Lamp assembly 26 and lens system 18 move in a timed relation with respect to drum 10 to project a non-distorted light image of the original document onto photoconductive surface 12. During exposure, filter mechanism 20 interposes a selected color filter into the optical light path of lens 18. The color filter operates on the light image passing through lens 18 recording an electrostatic latent image on photoconductive surface 12 corresponding to a specific color thereof. A suitable moving lens system is described in U.S. Pat. No. 3,062,108 issued to Mayo in 1962, and a suitable color filter mechanism is described in U.S. Pat. No. 3,775,006 issued to Hartman et al. in 1973. Hereinafter, the electrostatic latent image recorded on photoconductive surface 12 corresponding to a preselected spectral region of the electromagnetic wave spectrum will be referred to as a single color electrostatic latent image.

Next, the single color electrostatic latent image recorded on photoconductive surface 12 is rotated to development station C. Development station C includes three individual developer units generally indicated by the reference numerals 28, 30 and 32, respectively. All of the foregoing developer units are of a type generally referred to in the art as magnetic brush development systems. In a magnetic brush development system, a magnetizable developer mix of carrier granules and toner particles is continually brought through a directional flux field to form a brush-like array of developer mix. The developer mix is continually moving to provide a fresh supply to the brush. In the development system, a mass of developer mix adheres magnetically to a magnetic member. The developer mix includes carrier granules having toner particles clinging thereto via triboelectric attraction. The chain-like arrangement of developer mix simulates the fibers of a brush. Development is achieved when the toner particles adhering electrostatically to the carrier granules are attracted to the latent image recorded on the photoconductive surface 12. Each of the developer units 28, 30 and 32, respectively, has a pair of development electrodes and a plurality of vanes associated therewith. The development electrodes are adapted to enhance the development of the leading and trailing edges of the electrostatic latent image. The vanes are arranged to separate the toner particles from the carrier granules. In addition, a stream of air passes through the vanes forming a toner powder cloud in the development zone. A detailed discussion of the development system will be found hereinafter with reference to FIGS. 2 through 5, inclusive. Each of the developer units 28, 30 and 32, respectively, include toner particles adapted to absorb light within a preselected spectral region of the electromagnetic wave spectrum corresponding to the wavelength of light transmitted through the filter. For example, a latent image formed by passing the light image through a green filter will record the red and blue portions of the spectrum as areas of relatively high charged density on the photoconductive surface, while the green light rays will pass through the filter and cause the charged density on photoconductive surface 12 to be reduced to a voltage level ineffective for development. The charged areas are then made visible by applying green absorbing (magenta) toner particles to the latent image recorded on photoconductive surface 12. Similarly, a blue separation is developed with blue absorbing (yellow) toner particles while a red separation is developed with red absorbing (cyan) toner particles. After development, the now visible powder image is moved to transfer station D.

At transfer station D, the powder image is transferred to a sheet of final support material 34, such as plain paper, amongst others. Transfer is obtained by a transfer roll shown generally at 36. The surface of transfer roll 36 is electrically biased to a potential having a magnitude and polarity sufficient to electrostatically attract toner particles from photoconductive surface 12 to support sheet 34. Transfer roll 36 secures releasably thereto a single sheet of support material 34 for movement therewith in a recirculating path. Drum 10 and transfer roll 36 rotate in synchronism with one another. To this end, transfer roll 36 rotates in the direction of arrow 38 at about the same angular velocity as drum 10. In addition, transfer roll 36 and drum 10 are substantially the same diameter. In this manner, successive powder images are transferred to support material 34 in superimposed registration with one another. U.S. Pat. No. 3,612,677 issued to Langdon et al. in 1972 describes a suitable electrically biased transfer roll.

The aforementioned steps of charging the photoconductive surface, exposing the photoconductive surface to a specific color filtered light image of the original document, developing the electrostatic latent image recorded on the photoconductive surface with the appropriately colored toner particles, and transferring the single color toner powder image to the sheet of support material are repeated a plurality of cycles to form a color copy of the original document on the support sheet.

With continued reference to FIG. 1, the sheet feeding path will be described briefly hereinafter. A stack 40 of support material 34 is disposed on tray 42. Feed roll 44, operatively associated with retard roll 46, separates and advances the uppermost sheet from stack 40. The advancing sheet then moves into chute 48 which directs it into the nip of register rolls 50. Thereafter, gripper fingers 52, mounted on transfer roll 36, releasably secures support material 34 thereto for movement therewith in a recirculating path.

Continuing now with the printing process, after all of the discretely colored toner powder images have been transferred to support material 34, gripper fingers 52 space support material 34 from transfer roll 36. This permits stripper bar 54 to be interposed therebetween so as to separate support material 34 from transfer roll 36. Support material 34 is then positioned on endless belt conveyor 56 which advances it to fixing station E.

At fixing station E, a suitable fuser, indicated generally at 58, permanently affixes the toner powder image to support material 34. A typical fuser is described in U.S. Pat. No. 3,498,592 issued to Moser et al., in 1970. This type of fuser applies heat to the toner powder image so as to permanently set and affix it to support material 34. After the multi-layer toner powder image is fused, endless belt conveyors 60 and 62 advance support material 34 to catch tray 64. At catch tray 64, the machine operator is capable of removing the final color copy from the printing machine.

The final processing station, in the direction of rotation of drum 10, is cleaning station F. Although a preponderance of the toner particles are transferred to support material 34, invariably some residual toner particles remain on photoconductive surface 12. At cleaning station F, a brush 66 is positioned in contact with photoconductive surface 12 to remove residual toner particles adhering thereto. One type of suitable brush cleaning device is described in U.S. Pat. No. 3,590,412 issued to Gerbasi in 1971. Prior to removing the residual toner particles with brush 66, a corona generating device (not shown) neutralizes the electrostatic charge remaining on the toner particles and that of photoconductive surface 12. This facilitates the removal of the residual toner particles from photoconductive surface 12 by brush 66.

It is believed that the foregoing description is sufficient for purposes of the present invention to illustrate the general operation of a color electrophotographic printing machine embodying therein the development system of the present invention.

Figure 2:
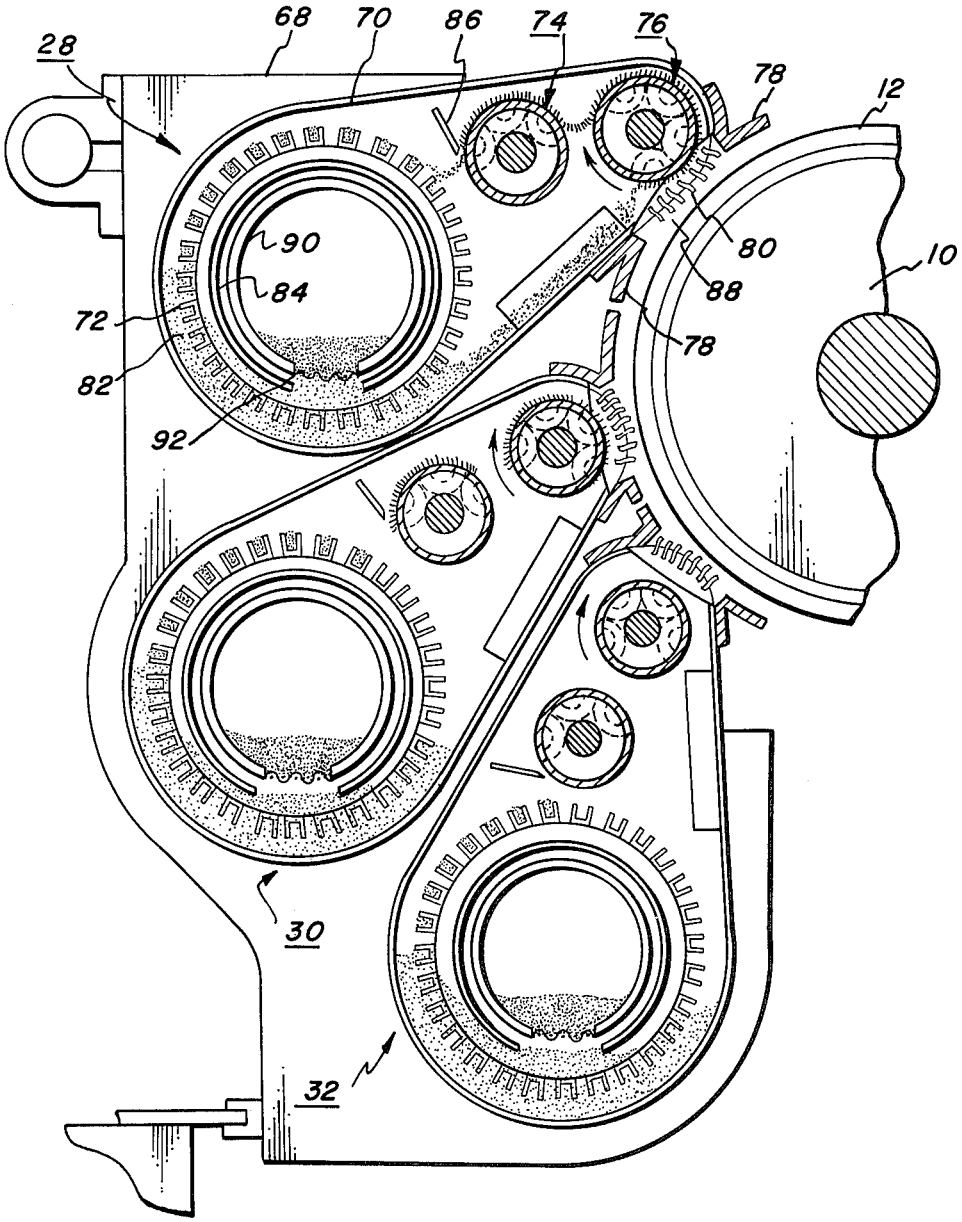
FIG. 2 is a sectional elevational view of the development system employed in the FIG. 1 printing machine.

Turning now to the subject matter of the present invention, FIG. 2 illustrates a multi-color development system. The development system includes a frame 68 mounted in the printing machine and supporting three developer units 28, 30 and 32, respectively. These developer units are depicted in an elevational sectional view to indicate more clearly the various components included therein. For purposes of explanation, developer unit 28 will only be discussed in detail, as developer units 30 and 32, are substantially identical thereto. The distinction between each of the developer units is the color of the toner particles contained therein and minor geometrical differences due to the mounting angle. Developer unit 28 may have yellow toner particles therein, unit 30 magenta toner particles, and unit 32 cyan toner particles, although different color combinations may also be employed. It should be noted that the basic features exclusive of the vanes of each of the developer units 28, 30 and 32 is described, in detail, in copending application Ser. No. 444,089 filed in 1974, the disclosure of which is hereby incorporated into the present application.

Figure 3:
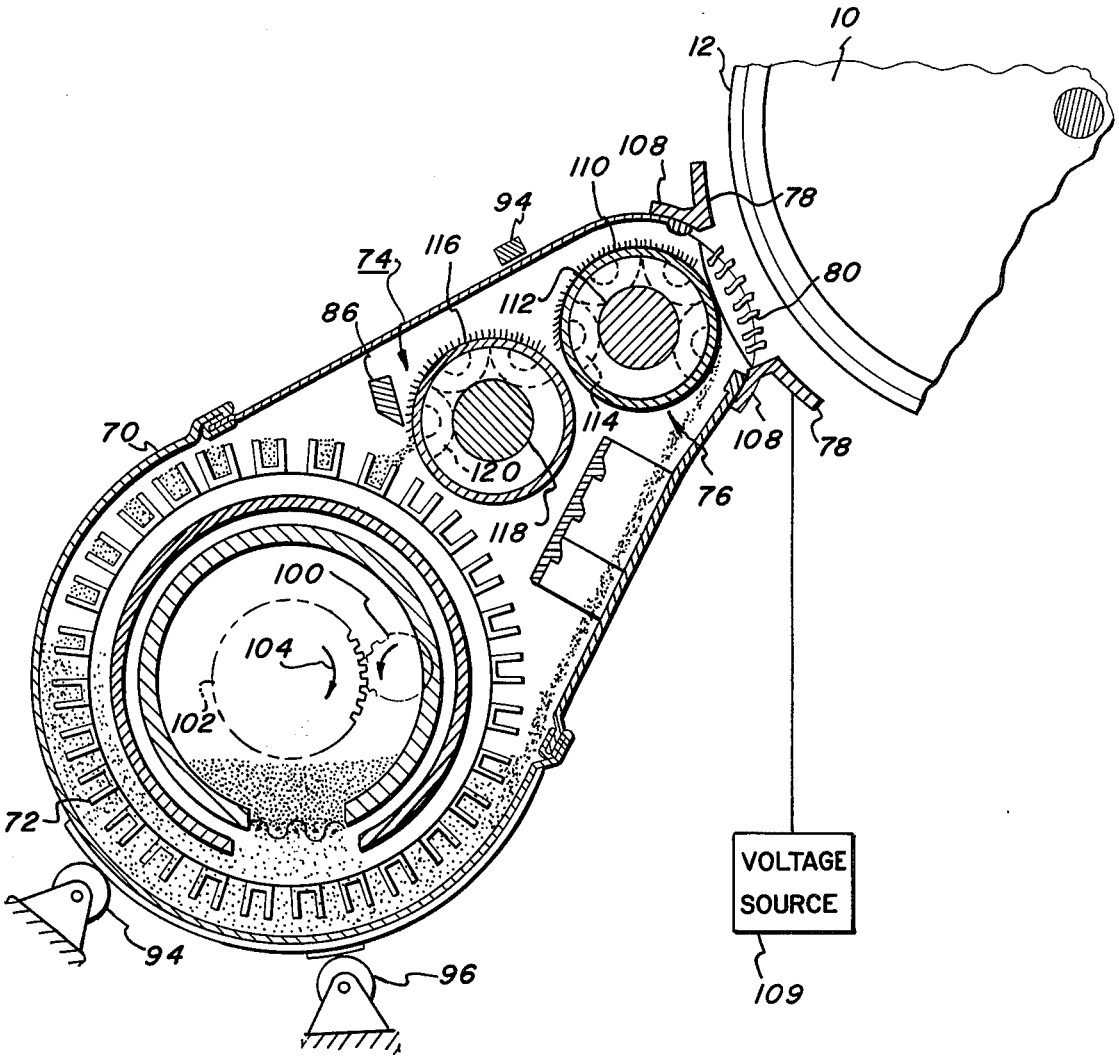
FIG. 3 is a fragmentary, sectional elevational view depicting, in detail, one of the FIG. 2 developer units.
Figure 4:
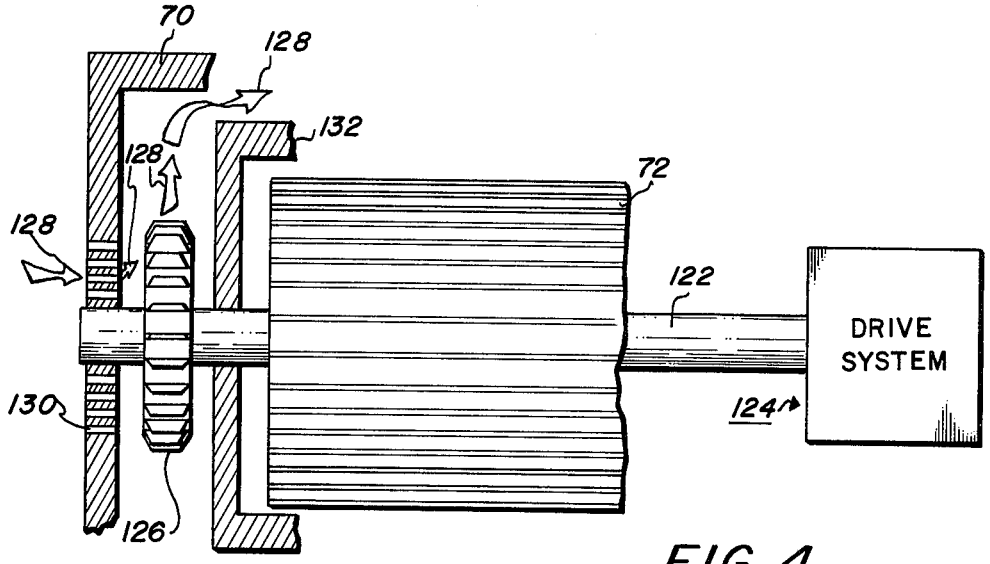
FIG. 4 is a fragmentary elevational view depicting the air flow in the FIG. 3 developer unit.
Figure 5:
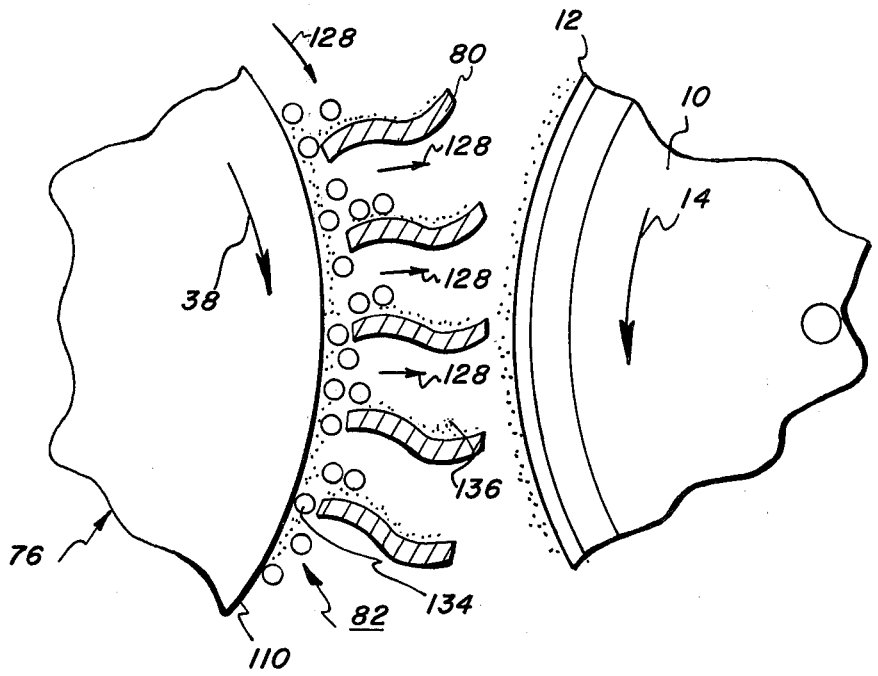
FIG. 5 is a fragmentary elevational view illustrating the development action.

The principle components of developer unit 28 are developer housing 70, paddle wheel 72, transport roll 74, developer roll 76, development electrode 78, and vanes 80. Paddle wheel 72 is a cylindrical member having buckets or scoops around the periphery thereof. It is adapted to rotate so as to elevate developer mix 82 from the lower region of housing 70 to the upper region thereof. When developer mix 82 reaches the upper region of housing 70, it is lifted from the paddle wheel buckets to transport roll 74. Alternate buckets of paddle wheel 72 have apertures in the root diameter so that the developer mix in those areas is not carried to transport roll 74, but, in lieu thereof, falls back to the lower region of developer housing 70. As the developer mix falls back to the lower region of developer housing 70, it cascades over shroud 84 in the lower region thereof. In this manner, developer mix 82 is recirculated so that the carrier granules will continually agitate to mix with fresh toner particles. This generates a strong triboelectric charge between the carrier granules and toner particles. As developer mix 82, in the paddle wheel buckets, approaches transport roll 74, the magnetic field produced by the fixed magnets therein attracts developer mix 82 thereto. Transport roll 74 moves developer mix 82 in an upwardly direction by the frictional force exerted by the roll surface on the developer mix. Surplus developer mix is furnished to transport roll 74. Metering blade 86 controls the amount of developer mix carried over the top of transport roll 74. Surplus developer mix 82 is sheared from transport roll 74 and falls in a downwardly direction toward paddle wheel 72. As the surplus developer mix descends, it falls through the apertures of paddle wheel 72 into the lower region of developer housing 70. The developer mix which passes metering blade 86 is carried over transport roll 74 to developer roll 76 and into development zone 88 located between photoconductive surface 12 and developer roll 76. In the development zone vanes 80 contact the developer mix and separate the toner particles from the carrier granules. An air stream is directed therebetween so as to move the toner particles into contact with the electrostatic latent image recorded on photoconductive surface 12 rendering it visible. Development electrodes 78 are positioned before and after developer rolls 76 being secured to developer housing 70. Development electrodes 78 are electrically biased to a potential somewhat greater than the background voltage of the latent image. Thus, development will occur in all regions having a potential greater than that of the electrical bias applied to vanes 80 and development electrodes 78. In effect, vanes 80 act as a screen. Hence, a magnetic brush development system is employed to create a toner powder cloud which is utilized to develop the electrostatic latent image recorded on photoconductive surface 12. FIGS. 3 through 5, inclusive, will describe the development process in greater detail.

Additional toner particles are furnished to developer mix 82 from toner particle storage container 90. Toner container 90 has a screen 92 located in the lower region thereof. A suitable motor oscillates container 90 to dispense prescribed amounts of toner particles to developer mix 82. In this fashion, the concentration of toner particles within developer mix 82 is maintained substantially constant. A detailed description of the toner particle storage container is contained in copending application Ser. No. 266,875 filed in1972, the disclosure of which is hereby incorporated into the present application.

Turning now to FIG. 3, developer housing 70 is pivoted about the center of paddle wheel 72. Developer housing 70 is supported at the lower region of the exterior surface thereof by rollers 94 and 96 mounted rotatably on frame 68. A spring (not shown) resiliently urges developer housing 70 against stop 94. In this position, developer roll 76 is in the non-operative position spaced from photoconductive surface 12. Operation begins when clutch gear 100 meshes with gear 102 which is attached to paddle wheel 72. This revolves paddle wheel 72 clockwise, as indicated by arrow 104. As paddle wheel 72 starts to rotate, a reaction torque is exerted against developer housing 70 due to the resistance to motion of developer mix 82 which fills developer housing 70. This reaction torque rotates housing 70 clockwise against the force of the spring until a stop, a wheel (not shown), is positioned against drum 10. Rolls 74 and 76 are rotated in conjunction with paddle wheel 72 by a gear train (not shown). Once the latent image recorded on photoconductive surface 12 has passed development zone 88, which extends from the end of one of development electrodes 78 to the end of the other development electrode 78, development action is discontinued. Air is directed in an upwardly direction through vanes 80 in the direction of arrow 128. As the developer mix of toner particles and carrier granules contacts a plurality of vanes 80 mounted fixedly to developer housing 70, the brush of developer mix which extends along a radial line from the center of developer roll 74 bends and flicks toner particles from the carrier granules. The freed toner particles are now directed by the air flow, moving in the direction of arrow 106, toward photoconductive surface 12. This creates a toner powder cloud adjacent the electrostatic latent image rendering it visible. Development electrodes 78, which are conductive plates, and vanes 80 are electrically biased by voltage source 109. Similarly, developer roll 76 is also electrically biased by voltage source 109. In this manner, developer roll 76, development electrode 78, and vanes 80 are all electrically biased to substantially the same potential. Voltage source 109 biases vanes 80, development electrodes 78 and developer rolls 76 to an electrical potential ranging from about 100 to about 500 volts. The developer bias will depend upon the desired background suppression. As shown in FIG. 3, only one power supply is provided, the same power supply being employed for the development electrodes, vanes and developer rolls. However, one skilled in the art will appreciate that one, two or three power supplies may be employed in lieu of the one depicted in FIG. 3, depending upon the desired electrical biasing ratios. After development is terminated, the drive motor is disconnected from gear 100 by de-energizing the clutch permitting gear 100 to rotate freely. Paddle wheel 72, developer roll 76 and transport roll 74 stop rotating and the spring pivots developer housing 70 counterclockwise until it engages stop 94 in its inoperative position. Development electrodes 78 are mounted on housing 70 with a layer of insulation 108 interposed therebetween.

In the preferred embodiment thereof, developer roll 76 includes a non-magnetic tubular member 110, preferably made from an aluminum tube having an irregular or roughened exterior surface. Tubular member 110 is mounted rotatably on shaft 112 by ball bearings. Shaft 112 is made, preferably, from stainless steel, and is mounted within tubular member 112 and also serves as a fixed mounting for magnets 114. Magnets 114, preferably, are made from barium ferrite in the form of annular rings and are arranged with five poles in a 284° arc about shaft 104.

Similarly, transport roll 74 includes a non-magnetic tubular member 116, also, preferably made from an aluminum tube having an irregular or roughened exterior surface. Tubular member 116 is journaled for rotation relative to shaft 118 and is secured rotatably thereon by ball bearings. Shaft 118, preferably, is made of steel and mounted concentrically within tubular member 116 to function at the fixed mounting for magnets 120. Magnets 120, preferably, are made from barium ferrite in the form of annular rings arranged to have four poles in a 180° arc about shaft 118.

Turning now to FIG. 4, there is shown the arrangement within developer housing 70 for creating an air flow to move the separated toner particles into contact with the electrostatic latent image recorded on photoconductive surface 12. As shown therein, paddle wheel 72 is mounted on shaft 122 secured to drive motor 124. Drive motor 124 is connected to shaft 122 by gears 100 and 102, as depicted in FIG. 3. In addition, impellor 126 is also mounted on shaft 122. Impellor 126 includes a plurality of vanes adapted to move air in the direction of arrow 128. Impellor 126 is mounted in a compartment within housing 70. The outer wall of housing 70 includes a plurality of apertures 130 through which air moves and is directed in the direction of arrow 128 into the development zone to move the toner particles separated from the carrier granules into contact with the electrostatic latent image recorded on photoconductive surface 12. Paddle wheel 72 is mounted in an interior chamber of developer housing 70 substantially airtight and the airflow directed from impellor 126 does not pass therein. Thus, inner walls 132 isolate paddle wheel 72 from the airflow.

Turning now to FIG. 5, there is shown the detailed development process. As shown therein tubular member 110 of developer roll 76 has developer mix 82 adhering to the surface thereof. Developer mix 82 includes carrier granules 134 and toner particles 136. Developer mix 82 extends in chain-like fibers along a radius of tubular member 110. As developer mix 82 contacts vanes 80, the brush like hairs flick backward and then forward separating a portion of the toner particles from the carrier granules. The separated toner particles are directed toward the electrostatic latent image recorded on photoconductive surface 12 of drum 10 by air flow moving in the direction of arrow 128.

By way of example, development electrodes are arcuate sheet-like baffles or plates extending, in the operative position, substantially parallel to and closely spaced from photoconductive surface 12. The development electrode plates extend in a lengthwise direction across substantially the entire surface of drum 10. A non-conductive insulating strip 108 is secured to the developer housing being interposed between each development electrode plate. These insulating strips are preferably made from a suitable plastic insulating material, such as Teflon amongst others. The non-conductive members are secured to the developer housing by suitable means such as cement or fasteners. Preferably, the development plates are spaced from photoconductive surface 12 by about 0.060 inches. The spacing may range from about 0.030 inches to about 0.090 inches. Similarly, each vane is spaced from its adjacent vane by about 0.060 inches. Spacing between the vanes may range from about 0.030 inches to about 0.090 inches. In addition, the leading edge of the vane is approximately 0.060 inches from photoconductive surface 12. The spacing between the leading edge of the vanes and photoconductive surface 12 may range from about 0.030 inches to about 0.090 inches. The vanes are preferably made from a conductive material such as a suitable metal.

From the foregoing, it is apparent that the development system of the present invention improves copies produced in an electrophotographic printing machine by utilizing a magnetic brush development system to create a toner powder cloud in the development zone. This is achieved by a combination including a magnetic brush, development electrodes and vanes all operating in conjunction with a directed air flow. The system is designed to move into and out of operative association with the respective electrostatic latent images permitting successive single color toner powder images to be developed on the photoconductive surface. Subsequently thereto, each of the single color toner powder images are transferred, in registration with one another, to a sheet of support material producing a multicolor copy of the colored original document.

It is, therefore, evident that there has been provided, in accordance with the present invention, an apparatus for developing an electrostatic latent image that fully satisfies the objects, aims and advantages set forth above. While this invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An apparatus for developing an electrostatic latent image with electrostatically charged particles, including:

magnetic field producing means operatively positioned closely adjacent to the latent image for generating a brush-like array of charged particles;

development electrode means associated with said magnetic field producing means;

means for separating a portion of the charged particles from the brush-like array thereof including a plurality of closely spaced vanes arranged to contact the brush-like array of charged particles; and means for moving the separated charged particles into contact with the latent image so as to render the latent image visible.

2. An apparatus as recited in claim 1, wherein said moving means includes a blower arranged to generate an air flow which moves the separate charged particles toward the latent image.

3. An apparatus as recited in claim 2, wherein said magnetic field producing means includes:

a tubular member of non-magnetic material journaled for rotary movement; and a magnetic member fixedly disposed within said tubular member for creating a magnetic field in the path of the periphery of said tubular member.

4. An apparatus as recited in claim 3, wherein said development electrode includes at least one conductive plate closely spaced to the electrostatic latent image.

5. An apparatus as recited in claim 4, further including means for electrically biasing said plurality of vanes.

6. An apparatus as recited in claim 5, further including means for electrically biasing said conductive plate.

7. An apparatus as recited in claim 6, further including means for electrically biasing said magnetic field producing means.

8. An electrophotographic printing machine of the type having a photoconductive member, means for charging the photoconductive member to a substantially uniform charge potential, and an exposure mechanism for projecting a light image corresponding to the original document being reproduced onto the charged photoconductive member to record thereon an electrostatic latent image thereof, wherein the improvement includes:

magnetic field producing means operatively positioned closely adjacent to the electrostatic latent image recorded on the photoconductive member for forming a brush-like array of developer mix comprising carrier granules and toner particles;

development electrode means associated with said magnetic field producing means;

means for separating a portion of the toner particles from the developer mix including a plurality of closely spaced vanes arranged to contact the brush-like array of developer mix; and means for moving the separated toner particles into contact with the electrostatic latent image recorded on the photoconductive member producing a toner powder image thereon.

9. A printing machine as recited in claim 8, wherein said moving means includes a blower arranged to generate an air flow which moves the separated toner particles toward the latent image recorded on the photoconductive member.

10. A printing machine as recited in claim 9, wherein said magnetic field producing means includes:

a tubular member of non-magnetic material journaled for rotary movement; and a magnetic member fixedly disposed within said tubular member for creating a magnetic field in the path of the periphery of said tubular member.

11. A printing machine as recited in claim 10, wherein said development electrode includes at least one conductive plate closely spaced to the electrostatic latent image recorded on the photoconductive member.

12. A printing machine as recited in claim 11, further including means for electrically biasing said plurality of vanes.

13. A printing machine as recited in claim 12, further including means for electrically biasing said conductive plate.

14. A printing machine as recited in claim 13, further including means for electrically biasing said magnetic field producing means.

* * * * *